United States Patent [19]

Stowell et al.

[11] 4,033,794

[45] July 5, 1977

[54] ALUMINIUM BASE ALLOYS

[75] Inventors: Michael James Stowell, Saffron Walden; Brian Michael Watts, Haverhill; Edward Frederick Emley, Chalfont St. Giles; Roger Grimes, Amersham, all of England

[73] Assignees: The British Aluminum Company, Limited, London; T. I. (Group Services) Limited, Birmingham, both of England

[22] Filed: Apr. 14, 1975

[21] Appl. No.: 567,505

Related U.S. Application Data

[63] Continuation of Ser. No. 433,618, Jan. 15, 1974, abandoned.

[30] Foreign Application Priority Data

Jan. 19, 1973 United Kingdom ..... 2846/73

[52] U.S. Cl. ..... 148/32; 29/527.7; 75/138; 75/147; 75/148; 148/2; 148/11.5 A

[51] Int. Cl.[2] ..... C22C 21/00

[58] Field of Search ..... 75/138, 147, 148; 148/2, 3, 11.5 A, 32, 32.5; 29/527.7

[56] References Cited

UNITED STATES PATENTS

| | | | |
|---|---|---|---|
| 1,932,841 | 10/1933 | Dean et al. | 75/147 |
| 2,245,166 | 6/1941 | Stroup | 75/147 |
| 2,670,309 | 2/1954 | McClintock et al. | 75/138 |
| 2,871,176 | 1/1959 | Draley et al. | 75/138 |
| 3,771,214 | 11/1973 | Binger et al. | 75/138 |

*Primary Examiner*—R. Dean
*Attorney, Agent, or Firm*—Karl W. Flocks

[57] ABSTRACT

It has now been found that alloys of the type that are the cheapest and most widely used for the production of formed components may also be provided with superplastic properties. Such alloys may comprise a selected non-heat treatable base material together with dynamic recrystallization modifying additives to achieve fine structure. The base material may be aluminium of normal commercial purity and the additives 0.4% to 2% iron and 0.4 to 2% silicon; or the base material may be aluminium and 0.75 to 2.5% manganese and the additive 0.4 to 1% iron; or the base material may be aluminium and 0.25 to 0.75% manganese with no additive; or the base material may be aluminium and 1 to 4% magnesium and the additive 0.25 to 0.75% manganese. In all these cases at least one of the elements Zr, Nb, Ta and Ni must also be present in an amount of at least 0.3% substantially all of which is in solid solution and the total amount of said elements not exceeding 1%. The remainder of the alloy may be normal impurities and known incidental elements.

14 Claims, No Drawings

ALUMINIUM BASE ALLOYS

This is a continuation, of application Ser. No. 433,618, filed Jan. 15, 1974 abandoned.

BACKGROUND OF THE INVENTION

This invention relates to aluminium-base alloys, and more particularly to aluminium-base alloys capable of being formed or shaped into objects by superplastic deformation.

It is known that certain alloys under certain conditions can undergo very large amounts of deformation without failure, the phenomenon being known as superplasticity and characterised by a high strain rate sensitivity index in the material as a result of which the normal tendency of a stretched specimen to undergo preferential local deformation ("necking") is suppressed. Such large deformations are moreover possible at relatively low stresses so that the forming or shaping of superplastic alloys can be performed more simply and cheaply than is possible with even highly ductile materials which do not exhibit the phenomenon. As a convenient numerical criterion of the presence of superplasticity, it may be taken that a superplastic material will show a strain rate sensitivity ("m"-value) of at least 0.3 and a uniaxial tensile elongation at temperature of at least 200%, m-value being defined by the relationship $\sigma = \eta\dot{\varepsilon}^n$ where $\sigma$ represents flow stress, $\eta$ a constant, $\dot{\varepsilon}$ strain rate and n strain rate sensitivity index.

No known aluminium-base alloy can be superplastically deformed other than the Al-Cu eutectic composition which contains 33% copper and has neither the low density nor the good corrosion resistance characteristic of aluminium alloys.

In the Complete Specification of copending British patent application No. 33922/71 (U.S. pat. Ser. No. 273,639) now U.S. Pat. No. 3,876,474 aluminium base alloys are described which can be superplastically deformed. These include non-heat treatable alloys containing at least 5% magnesium or at least 1% zinc, together with at least one of the elements Zr, Nb, Ta and Ni in a total amount of 0.3% to 0.8% substantially all of which is present in solid solution.

It was not found possible, by inclusion of even considerable amounts of zirconium in the desired form, to induce superplastic behaviour in pure aluminium or the Al-1¼% Mn alloys or in Al-Mg alloys containing a few percent only of magnesium, although these are the cheapest and most widely used types of aluminium alloy for production of formed components.

SUMMARY OF THE INVENTION

According to one aspect of the present invention a superplastically deformable aluminium base alloy consists of a non-heat treatable base material selected from the group consisting of:

1. Aluminium of normal commercial purity;
2. Aluminium and 0.75 to 2.5% manganese;
3. Aluminium and 0.25 to 0.75% manganese; and
4. Aluminium and 1 to 4% magnesium;

together with dynamic recrystallisation modifying additives for these materials to achieve fine structure respectively consisting of:

1. 0.4% to 2% iron and 0.4% to 2% silicon;
2. 0.4% to 1% iron;
3. nil;

4. 0.25% to 0.75% manganese; and at least one of the elements Zr, Nb, Ta and Ni in an amount of at least 0.3% substantially all of which is present in solid solution, the total amount of said elements not exceeding 1% and the remainder being normal impurities and known incidental elements. The preferred one of said elements is Zr and the amount is advantageously not more than 0.8% and preferably 0.4% to 0.7%.

According to another aspect of the present invention a superplastically deformable aluminium base alloy consists of aluminium of normal commercial purity together with 0.4% to 2% iron and 0.4% to 2% silicon and at least one of the elements Zr, Nb, Ta and Ni in an amount of at least 0.3% substantially all of which is present in solid solution the total amount of said elements not exceeding 1% and the balance being normal impurities and known incidental elements. The total content of iron and silicon should preferably be 0.75% to 2% and they should preferably be in equal proportions by weight.

According to yet another aspect of the present invention a superplastically deformable aluminium base alloy consists of a non-heat treatable aluminium base alloy containing 0.75% to 2.5% manganese together with 0.4% to 1% iron and at least one of the elements Zr, Nb, Ta and Ni in an amount of at least 0.3% substantially all of which is present in solid solution, the total amount of said elements not exceeding 1% and the balance being normal impurities and known incidental elements. The manganese addition should preferably be in the range 1% to 2% with an iron content of at least 0.6%.

According to a further aspect of the present invention a superplastically deformable aluminium base alloy consists of a non-heat treatable aluminium base alloy containing 0.25% to 0.75% manganese and at least one of the elements Zr, Nb, Ta and Ni in an amount of at least 0.3% substantially all of which is present in solid solution, the total amount of said elements not exceeding 1% and the balance being normal impurities and known incidental elements.

According to yet a further aspect of the present invention a superplastically deformable aluminium base alloy consists of a non-heat treatable aluminium base alloy containing 1% to 4% magnesium together with 0.25% to 0.75% manganese and at least one of the elements Zr, Nb, Ta and Ni in an amount of at least 0.3% substantially all of which is present in solid solution, the total amount of said elements not exceeding 1% and the remainder being normal impurities and known incidental elements. Preferably the manganese content is 0.3% to 0.5%.

In another aspect the present invention provides a superplastically deformable aluminium alloy consisting of a non-heat treatable aluminium base alloy capable of dynamic recrystallization to a fine structure during hot deformation, and at least one of the elements Zr, Nb, Ta and Ni in an amount of at least 0.3% substantially all of which is present in solid solution, the total amount of said elements not exceeding 1.0% and the balance being normal impurities and known incidental elements. The base alloy may consist of aluminium of normal commercial purity containing from 0.4 to 2% Fe and 0.4 to 2% Si. Preferably the alloy contains a total of from 0.75 to 2% of Fe and Si and ideally it contains equal proportions by weight of Fe and Si.

The base alloy may consist of aluminium containing from 0.75 to 2.5% of Mn and from 0.4 to 1% of Fe and preferably contains from 1 to 2% of Mn and at least 0.6% of Fe.

The base alloy may consist of aluminium and from 0.25 to 0.75% of Mn and preferably contains from 0.3 to 0.5% of Mn. In addition the alloy may contain from 1 to 4% of Mg. The total amount of Zr, Nb, Ta and Ni should preferably not exceed 0.8% and ideally is from 0.4 to 0.7%.

According to a further feature of the present invention a method of making a superplastically deformable aluminium-base alloy semi-fabricated product comprises casting a liquid alloy having a composition according to any one of the immediately preceding five paragraphs at a temperature of at least 775° C and preferably in excess of 800° C to produce a cell size in the cast alloy not exceeding 30 μM and subjecting the cast alloy to plastic working at a temperature not substantially in excess of 550° C.

In the alloy of the present invention, in addition to normal impurities, such as silicon where this element is not required as a specified constituent, common incidental elements for example beryllium, titanium and boron, may be added to achieve known effects, for example to control oxidation or effect grain refinement of the cast structure.

By cell size is meant secondary dendrite arm spacing.

DESCRIPTION OF THE PREFERRED EMBODIMENTS

Throughout this specification all percentages are by weight.

Investigations of the mechanism by which superplastic behaviour is achieved in the alloys of British patent application No. 33922/71 indicated that some dynamic recrystallisation was taking place during the course of the superplastic deformation whereas alloys which were recrystallised prior to the hot forming operation and those which remained unrecrystallised after hot forming did not exhibit superplasticity. With this information it was possible to prescribe additional elements which, by reducing the high stacking fault energy of aluminium, would advance recrystallisation and enable some dynamic recrystallisation to a fine structure to take place during hot deformation in the case of the pure aluminium and the Al-1¼% Mn alloy. Similarly it was possible to prescribe additions to retard recrystallisation to a fine structure in the case of the low alloyed Al-Mg alloys. When these recrystallisation-controlling additions were made to these three kinds of alloy which, with zirconium additions alone, could not previously be made superplastic, all three materials could be superplastically deformed as shown by the results of Table 1.

TABLE 1

| Alloy Type | Additives to modify dynamic recrystallisation: By advancing recrystallisation | By retarding recrystallisation | Elongation (%) with optimum temp. conditions: Without recryst. controlling addn. | With recryst. controlling addn. |
|---|---|---|---|---|
| Pure Al (+0.5% Zr) | 0.8% Fe + 0.8% Si | — | 172 | 440 |
| Al-1¼% MN (+0.5% Zr) | 0.6FE | — | <200 | 448 |
| Al-2% Mg (+0.5% Zr) | — | 0.3% Mn | 170 | 300 |

Alternatively, in the case of Al-Mn alloys dynamic recrystallisation could be encouraged by reducing the manganese content, in which situation it was not necessary to make any further addition apart from zirconium. These alloys of lower manganese content could then be superplastically deformed as shown by the results of Table 2.

TABLE 2

| Alloy | Elongation (%) with optimum temperature conditions |
|---|---|
| Al-0.6% Mn-0.5% Zr | 400 |
| Al-0.3% Mn-0.5% Zr | 356 |

The alloys of the present invention should be cast at a temperature of at least 775° C and preferably in excess of 800° C to produce a cell size in the cast alloy not exceeding 30 μM. The cast alloy may then be subjected to plastic working at a temperature not substantially in excess of 550° C.

The present invention provides superplastically deformable aluminium base alloys which are (apart from their superplasticity) not only of a cheap type of alloy but are also those which are generally known to producers of conventionally formed components.

If desired the alloys may be subjected to a conventional cold forming operation either before or after superplastic deformation.

It will be understood that although only the addition of Zr has been illustrated above the use of Nb, Ta and Ni as disclosed in British patent application No. 33922/71 is also envisaged.

It will also be understood that when the cast alloy is subsequently rolled or otherwise formed the percentage of Zr, Nb, Ta and Ni which remains in solid solution may be changed.

Whether the rolled or otherwise formed alloy remains superplastic will depend both upon the residual quantity of Zr, Nb, Ta and Ni which remains in solid solution and the amount of grain refining caused by some of the Zr, Nb, Ta and Ni coming out of solid solution.

Thus a cast alloy according to the present invention may be partially formed by various processes and retain the properties of superplasticity.

We claim:

1. A superplastically deformable wrought aluminium-base alloy consisting of 1. non-heat treatable aluminium-base alloy selected from the group consisting of 1a. aluminium of normal commercial purity together with 0.4% to 2% iron and 0.4% to 2% silicon as dynamic recrystallization modifying additives to achieve fine structure during deformation, 1b. aluminium and 0.75% to 2.5% manganese together with 0.4% to 1% iron as dynamic recrystallization additive to achieve fine structure during deformation, 1c. aluminium and 0.25% to 0.75% manganese, and 1d. aluminium and 1% to 4% magnesium together with 0.25 to 0.75% manganese as dynamic recrystallization additive to achieve fine structure during deformation, and 2. zirconium in an amount of 0.3% to 1.0% in total content of which at least 0.3% is present in solid solution;

3. the remainder of said superplastically deformable alloy being normal impurities and incidental elements known to be incorporated in said aluminium-base alloys.

2. An alloy according to claim 1 in which said Zr is present in an amount not more than 0.8%.

3. An alloy according to claim 2 in which the amount is 0.4% to 0.7%.

4. An alloy according to claim 1, in which said total amount of Zr is not greater than 0.8%.

5. An alloy according to claim 4, in which said total amount of Zr is from 0.4 to 0.7%.

6. A superplastically deformable aluminium base non-heat treatable alloy consisting of aluminium of normal commercial purity together with 0.4% to 2% iron and 0.4% to 2% silicon and Zr in an amount of 0.3% to 1.0% in total content of which at least 0.3% is present in solid solution and the balance being normal impurities and known incidental element.

7. An alloy according to claim 6 in which the total content of iron and silicon is 0.8% to 2%.

8. An alloy according to claim 7 in which the iron and silicon are in equal proportions by weight.

9. A superplastically deformable aluminium alloy consisting of a non-heat treatable aluminium base alloy containing 0.75% to 2.5% manganese together with 0.4% to 1% iron and Zr in an amount of 0.3% to 1.0% in total content of which at least 0.3% is present in solid solution, and the balance being normal impurities and known incidental elements.

10. An alloy according to claim 9 in which the manganese addition is in the range 1% to 2% with an iron content of at least 0.6%.

11. A superplastically deformable aluminium base alloy consisting of a non-heat treatable aluminium base alloy containing 0.25% to 0.75% manganese and Zr in an amount of 0.3% to 1.0% in total content of which at least 0.3% is present in solid solution and the balance being normal impurities and known incidental elements.

12. A superplastically deformable aluminium base alloy consisting of a non-heat treatable aluminium base alloy containing 1% to 4% magnesium together with 0.25% to 0.75% manganese and Zr in an amount of 0.3% to 1.0% in total content, of which at least 0.3% is present in solid solution, and the remainder being normal impurities and known incidental elements.

13. An alloy according to claim 12 in which the manganese content is 0.3% to 0.5%.

14. A method of making a super plastically deformable aluminium-base alloy semi-fabricated product comprising casting a liquid alloy having a composition according to claim 1 at a temperature of at least 775° C to produce a cell size in the cast alloy not exceeding 30 $\mu$M and subjecting the cast alloy to plastic working at a temperature not substantially in excess of 550° C.

* * * * *